US011523634B2

(12) United States Patent
Liu et al.

(10) Patent No.: US 11,523,634 B2
(45) Date of Patent: Dec. 13, 2022

(54) ULTRASONIC ELECTRONIC CIGARETTE ATOMIZING CORE AND ATOMIZER

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Yuangang Dai, Hunan (CN); Xinqiang Yin, Hunan (CN); Jianhua Yi, Hunan (CN); Hong Yu, Hunan (CN); Lizhou Shen, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 988 days.

(21) Appl. No.: 16/322,262

(22) PCT Filed: Dec. 17, 2016

(86) PCT No.: PCT/CN2016/110585

§ 371 (c)(1),
(2) Date: Jan. 31, 2019

(87) PCT Pub. No.: WO2018/023920

PCT Pub. Date: Feb. 8, 2018

(65) Prior Publication Data

US 2019/0166905 A1 Jun. 6, 2019

(30) Foreign Application Priority Data

Aug. 3, 2016 (CN) ..... 201620833328.6

(51) Int. Cl.
*A24F 40/44* (2020.01)
*A24F 40/05* (2020.01)
(Continued)

(52) U.S. Cl.
CPC ..... *A24F 40/44* (2020.01); *A24F 40/05* (2020.01); *A24F 40/485* (2020.01); *B05B 17/06* (2013.01); *A24F 40/10* (2020.01)

(58) Field of Classification Search
CPC ..... A24F 40/44; A24F 40/485; A24F 40/05; A24F 40/10; B05B 17/06
(Continued)

(56) References Cited

U.S. PATENT DOCUMENTS 7,719,830 B2 * 5/2010 Howarth ..... G06F 1/1632 361/679.56
9,103,484 B2 * 8/2015 Hayashi ..... F16M 13/00
(Continued)

FOREIGN PATENT DOCUMENTS

CN 202286306 U 7/2012
CN 105559151 A * 5/2016 ..... A24F 40/05
(Continued)

OTHER PUBLICATIONS

International Search Report issued in international Application No. PCT/CN2016/110585 dated May 8, 2017.

*Primary Examiner* — Peter G Leigh
(74) *Attorney, Agent, or Firm* — Mauriel Kapouytian Woods LLP; Liang Huang

(57) ABSTRACT

An ultrasonic electronic cigarette atomizing core and atomizer is provided, the atomizing core including an atomizing core sleeve, and tobacco tar guide cotton and an atomizing piece in the atomizing core sleeve.

16 Claims, 12 Drawing Sheets

(51) Int. Cl.
*A24F 40/485* (2020.01)
*B05B 17/06* (2006.01)
*A24F 40/10* (2020.01)

(58) Field of Classification Search
USPC ..... 131/329
See application file for complete search history.

(56) References Cited

U.S. PATENT DOCUMENTS

| | | | | |
|---|---|---|---|---|
| 2011/0079701 | A1* | 4/2011 | Hayashi | F16M 13/00 248/346.04 |
| 2015/0036283 | A1* | 2/2015 | Suckle | G06F 1/1632 361/679.41 |

FOREIGN PATENT DOCUMENTS

| | | | | |
|---|---|---|---|---|
| CN | 105559151 | A | 5/2016 | |
| CN | 105795522 | A | 7/2016 | |
| CN | 105795526 | A | 7/2016 | |
| CN | 205757214 | U | 12/2016 | |
| KR | 20130006714 | U | 11/2013 | |
| WO | WO-2015017827 | A1 * | 2/2015 | G06F 1/1632 |
| WO | 2016/118941 | A1 | 7/2016 | |

* cited by examiner

ULTRASONIC ELECTRONIC CIGARETTE ATOMIZING CORE AND ATOMIZER

CROSS REFERENCE TO RELATED APPLICATIONS

This application is a national phase application of international application number PCT/CN2016/110585 filed on Dec. 17, 2016, which claims priority to Chinese application number 201620833328.6 filed on Aug. 3, 2016. The entire contents of these applications are hereby incorporated herein by reference.

FIELD OF THE INVENTION

The present invention belongs to the field of electronic cigarettes, and particularly relates to an ultrasonic electronic cigarette atomizing core and atomizer.

BACKGROUND OF THE INVENTION

The existing high-frequency ultrasonic electronic cigarette atomizing core has the following disadvantages:

Firstly, tobacco tar guide cotton is of a flaky structure placed flatwise, the whole piece of tobacco tar guide cotton is laminated on the surface of an atomizing piece, so the contact area between the tobacco tar guide cotton and the atomizing piece is large, and the atomization can only be started after waiting for tens of seconds.

Secondly, both of the tobacco tar guide cotton and the atomizing piece are erected on a silica gel seat, the silica gel seat is axially extruded to indirectly extrude the tobacco tar guide cotton so as to control the tightness of the tobacco tar guide cotton, thereby the tobacco tar guide speed of the tobacco tar guide cotton is controlled, and this manner is possible to lead to excessive extrusion of the atomizing piece to affect the oscillation effect.

Thirdly, as an tobacco tar inlet hole is vertically formed downward in the tobacco tar guide cotton directly, the distance between the tobacco tar inlet hole and the atomizing piece is small. When the temperature of the atomizing piece rises, the fluidity of the tobacco tar becomes stronger, and the tobacco tar guide speed of the tobacco tar is very high, therefore the tobacco tar guide speed cannot be well controlled, and an tobacco tar submersion phenomenon is produced easily, resulting in that the atomizing piece is hard to atomize the tobacco tar.

Fourthly, as an atomizing core sleeve is of a single-layer pipe wall structure, the heat is transferred to an atomizer outer pipe on the outer layer very easily, resulting in a relatively serious burning hot phenomenon of the atomizer outer pipe.

SUMMARY OF THE INVENTION

The objective of the present invention is to provide an improved ultrasonic electronic cigarette atomizing core and atomizer in view of the above shortcomings of the prior art, in which the atomization start up speed is fast, the oscillation effect of an atomizing piece is good, the stability of the tobacco tar guide speed is good, the controllability of the tobacco tar guide speed is high, an atomizer outer pipe is unlikely to become burning hot, meanwhile the inhalation of large-particle smoke can be avoided, and the atomizing core is convenient to be replaced.

In order to solve the above-mentioned technical problems, the technical solution adopted by the present invention is as follows:

An ultrasonic electronic cigarette atomizing core includes an atomizing core sleeve, and tobacco tar guide cotton and an atomizing piece in the atomizing core sleeve, the bottom surface of the tobacco tar guide cotton is in contact with the top surface of the atomizing piece, and a first through hole is formed in a position corresponding to the center of the atomizing piece, on the tobacco tar guide cotton.

As the first through hole is formed in the position corresponding to the center of the atomizing piece on the tobacco tar guide cotton, the atomization speed can be effectively improved because the center of the atomizing piece is not blocked by the tobacco tar guide cotton, the tobacco tar can be instantly atomized to produce smoke instantaneously, and the problems of the tobacco tar submersion and the slow atomization start up speed can be well improved.

Further, the atomizing core sleeve includes an atomizing core inner sleeve and an atomizing core outer sleeve sheathed at the outside of the atomizing core inner sleeve, the tobacco tar guide cotton is of a cup-shaped structure with an upward opening, and the side wall of the tobacco tar guide cotton is sandwiched between the atomizing core inner sleeve and the atomizing core outer sleeve.

By means of the above structure, as a narrow slit between the atomizing core inner sleeve and the atomizing core outer sleeve extrudes the side wall of the tobacco tar guide cotton to a certain extent, the tightness of the tobacco tar guide cotton can be controlled by extruding the atomizing core inner sleeve and the atomizing core outer sleeve, so as to control the tobacco tar guide speed of the tobacco tar guide path. The tightness of the side wall of the tobacco tar guide cotton can be well controlled by simply controlling the volume of the side wall of the cup-shaped tobacco tar guide cotton, so as to well control the tobacco tar guide speed.

Further, at least one second through hole is further formed in the bottom surface of the tobacco tar guide cotton.

The second through hole is a smoke inlet, and the arrangement of the second through hole can enable smoke to be quickly conveyed to a suction nozzle to be inhaled by a user.

Further, vent grooves are uniformly formed in a boundary area of the side wall and the bottom of the tobacco tar guide cotton in the circumferential direction, and the area provided with no vent groove at the bottom of the tobacco tar guide cotton is contacted with the atomizing piece.

In the solution, the bottom of the tobacco tar guide cotton is divided into a plurality of tiny tobacco tar guide strips, the tobacco tar guide strips are in contact with the atomizing piece to ensure more sufficient atomization, and moreover, mixing with the air entering from the outside is more sufficient.

Further, the bottom surface of the tobacco tar guide cotton is a downward protruding circular arc surface, and the circular arc surface is in contact with the central position of the atomizing piece.

By means of the above structure, the center of the tobacco tar guide cotton is contacted with the center of the atomizing piece locally and in small area, heat can be concentrated at the small area contact site so as to avoid loss of heat, and the atomization speed of the atomizing piece can be improved to a great extent, that is, the smoke can be produced quickly once a switch is pressed.

Further, an tobacco tar inlet hole which communicates with the tobacco tar guide cotton is formed in the atomizing core outer sleeve.

By means of the above structure, there is a certain distance between the tobacco tar inlet hole and the atomizing piece, therefore the temperature at the tobacco tar inlet hole will not be too high, and the temperature is relatively stable, accordingly the tobacco tar flow speed is relatively stable, the tobacco tar guide speed is relatively stable, the tobacco tar guide speed of the tobacco tar guide cotton can be well controlled, and the tobacco tar submersion problem is solved.

Further, at least one groove is formed in a position corresponding to the tobacco tar guide cotton, on the outer side wall of the atomizing core inner sleeve.

The groove can reduce the frictional force caused by the contact between the outer side wall of the atomizing core inner sleeve and the tobacco tar guide cotton during assembly, thereby the assembly is convenient; meanwhile, the tobacco tar guide cotton in the position corresponding to the groove is not extruded, so the tobacco tar guide speed of the tobacco tar guide cotton is relatively high; and furthermore, the groove can also store a certain amount of tobacco tar, therefore the tobacco tar consumed by atomization can be supplemented instantly so as to avoid the shortage of the tobacco tar supply.

Further, the ultrasonic electronic cigarette atomizing core further includes an elastic bracket, a step is formed on the inner side wall of the atomizing core inner sleeve, the top end of the elastic bracket is clamped at the step, and the other end of the elastic bracket extrudes the inner bottom surface of the tobacco tar guide cotton.

The elastic bracket extrudes the inner bottom surface of the tobacco tar guide cotton, therefore the tobacco tar guide cotton can be prevented from being sucked upward to deviate from the surface of the atomizing piece while smoking, thus avoid poor contact between the tobacco tar guide cotton and the atomizing piece.

Based on the same inventive concept, the present invention further provides an ultrasonic electronic cigarette atomizer, including an atomizer outer pipe, and the ultrasonic electronic cigarette atomizing core is arranged in the atomizer outer pipe.

Heat is indirectly transferred between the atomizing core and the whole atomizer outer pipe through multiple layers of pipe walls, the heat transfer is reduced to a certain extent, so that the burning hot problem of the atomizer outer pipe is improved to a certain extent.

Further, the ultrasonic electronic cigarette atomizer further includes a vent pipe, a first connecting seat, an airflow baffle and a suction nozzle, an air inlet hole is formed in the side wall of the bottom of the suction nozzle, the bottom end of the suction nozzle is connected with the top end of the side wall of the atomizer outer pipe, the bottom end of the vent pipe extends into the atomizing core sleeve, the top end of the vent pipe is connected with the airflow baffle through the first connecting seat, and the airflow baffle is horizontally arranged in the suction nozzle; at least one third through hole is formed in the airflow baffle in the circumferential direction; and all of the air inlet hole, the vent pipe and the third through hole communicate with the suction nozzle.

The airflow baffle is arranged at the suction nozzle, the airflow firstly impacts the airflow baffle and then turns into the oral cavity of a human body, and thus the inhalation of large-particle smoke can be well avoided.

As a preferred mode, the bottom end of the suction nozzle is connected with the top end of the side wall of the atomizer outer pipe through an upper end cover, and the bottom end of the side wall of the atomizer outer pipe is connected with a bottom seat through a lower end cover; and the top end of the atomizing core is in insertion connection with the upper end cover, and the bottom end of the atomizing core is in screw joint with the bottom seat.

By means of the above structure, the atomizing core can be directly detached manually, thereby being very convenient to be replaced.

Compared with the prior art, the present invention has the advantages that the atomization start up speed is fast, the oscillation effect of the atomizing piece is good, the stability of the tobacco tar guide speed is good, the controllability of the tobacco tar guide speed is high, the atomizer outer pipe is unlikely to become burning hot, meanwhile the inhalation of large-particle smoke can be avoided, and the atomizing core is convenient to be replaced.

REFERENCE SIGNS

1—tobacco tar guide cotton, 2—atomizing piece, 3—first through hole, 4—atomizing core inner sleeve, 5—atomizing core outer sleeve, 6—second through hole, 7—tobacco tar inlet hole, 8—groove, 9—elastic bracket, 10—step, 11—atomizer outer pipe, 12—vent pipe, 13—first connecting seat, 14—airflow baffle, 15—suction nozzle, 16—air inlet hole, 17—third through hole, 18—upper end cover, 19—lower end cover, 20—silica gel seat, 21—air adjusting ring, 22—first sealing ring, 23—upper sealing ring, 24—lower sealing ring, 25—second connecting seat, 26—second sealing ring, 27—insulating ring, 28—electrode ring, 29—spring electrode, 30—tobacco tar bin, 31—bottom seat, and 32—vent groove.

DETAILED DESCRIPTION OF THE EMBODIMENTS

Figure 1:
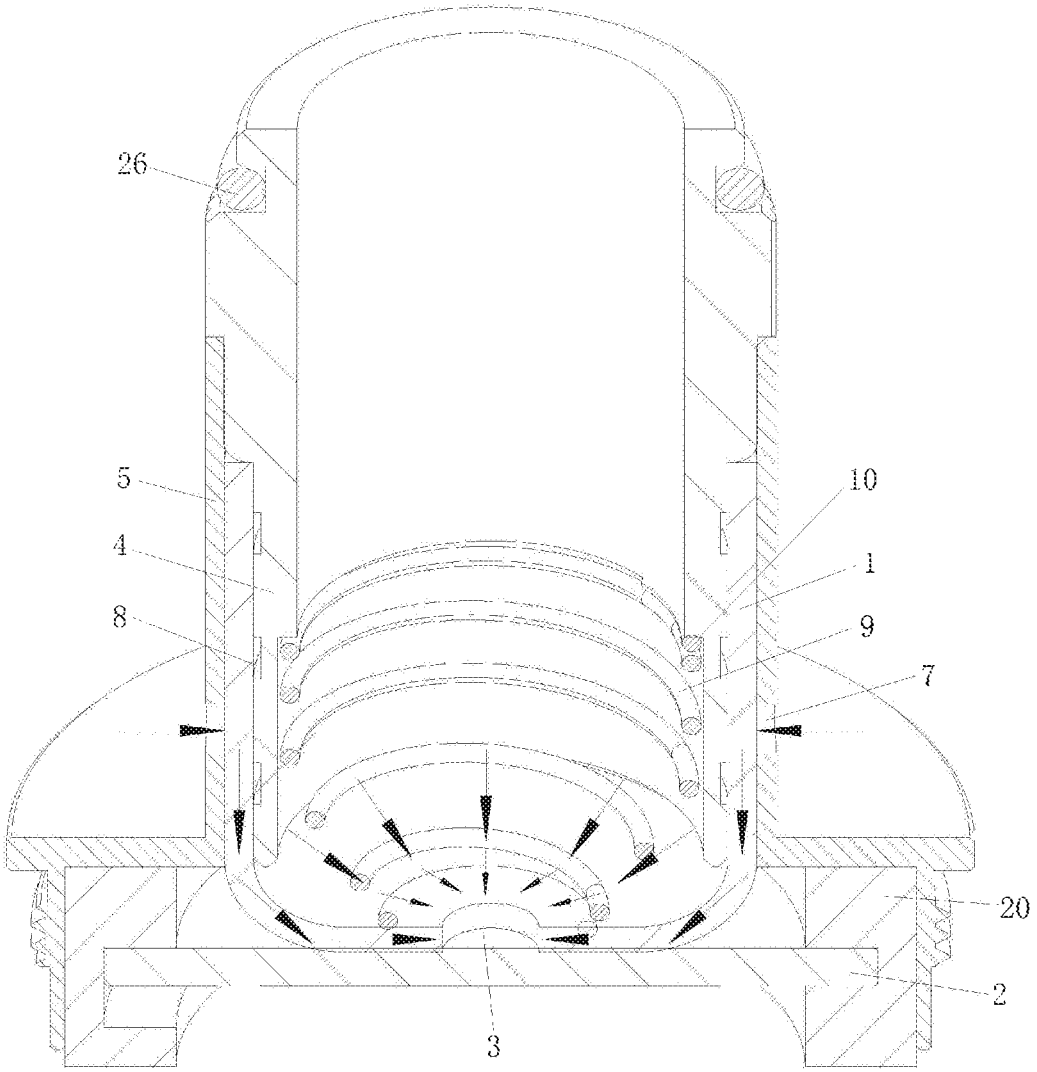
FIG. 1 is an oblique section view of an embodiment 1 of an atomizing core of the present invention.
Figure 2:
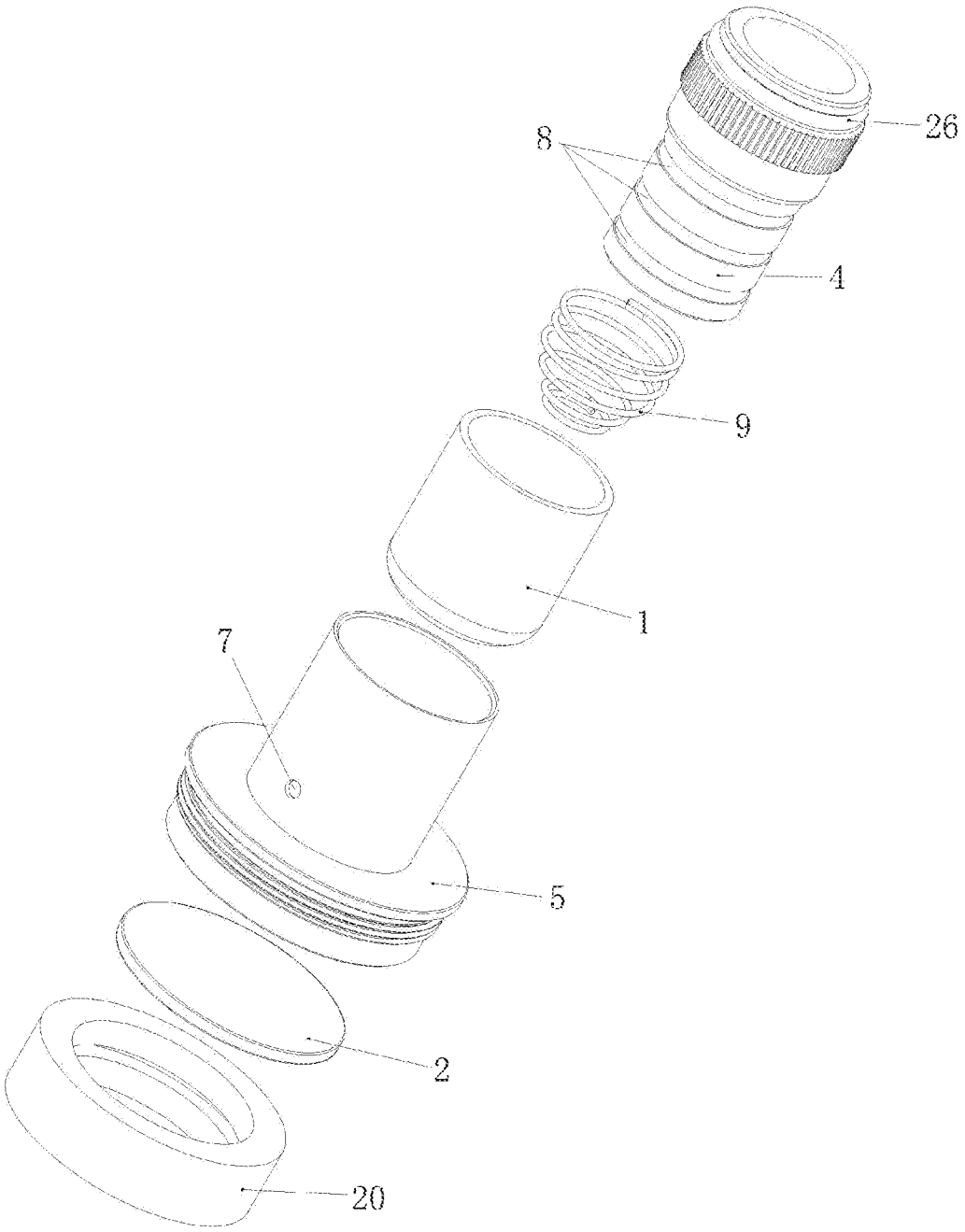
FIG. 2 is an explosive view of FIG. 1.
Figure 3:
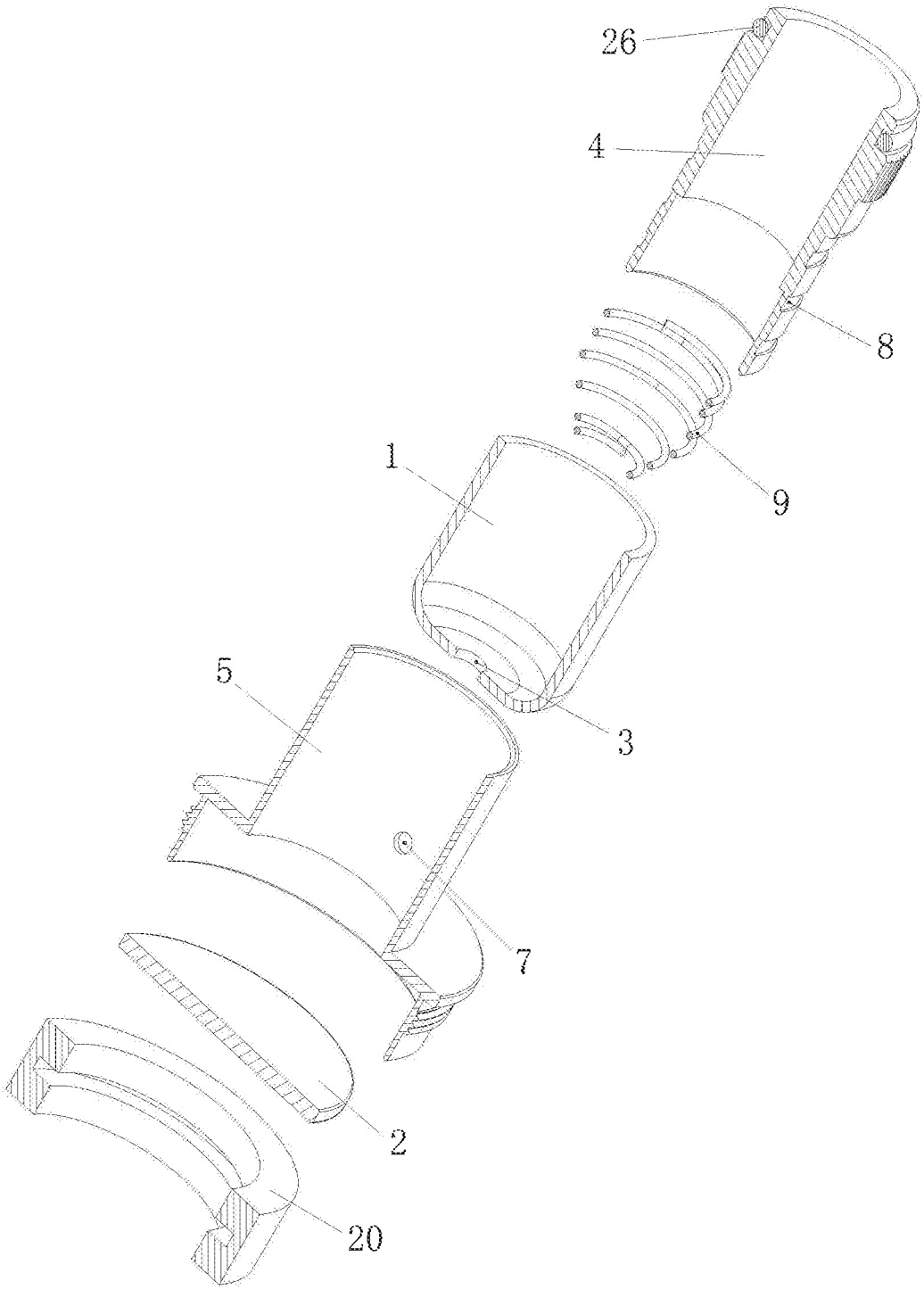
FIG. 3 is an oblique section view of FIG. 2.

As shown in FIG. 1 to FIG. 3, an embodiment 1 of an atomizing core of the present invention includes an atomizing core sleeve, and tobacco tar guide cotton 1 and an atomizing piece 2 in the atomizing core sleeve, the bottom surface of the tobacco tar guide cotton 1 is in contact with the top surface of the atomizing piece 2, and a first through hole 3 is formed in a position corresponding to the center of the atomizing piece 2, on the tobacco tar guide cotton 1. The diameter of the first through hole 3 is 0.2-3 mm.

The atomizing core sleeve includes an atomizing core inner sleeve 4 and an atomizing core outer sleeve 5 sheathed at the outside of the atomizing core inner sleeve 4, the tobacco tar guide cotton 1 is of a cup-shaped structure with an upward opening, and the side wall of the tobacco tar guide cotton 1 is sandwiched between the atomizing core inner sleeve 4 and the atomizing core outer sleeve 5. A silica gel seat 20 is arranged in the bottom of the atomizing core outer sleeve 5, and the atomizing piece 2 is erected on the silica gel seat 20.

The bottom surface of the tobacco tar guide cotton 1 is a downward protruding circular arc surface, and the circular arc surface is in contact with the central position of the atomizing piece 2. The bottom surface of the tobacco tar guide cotton 1 in contact with the atomizing piece 2 shrinks to a structure similar to circular arc surface.

A plurality of tobacco tar inlet holes 7 communicated with the tobacco tar guide cotton 1 are formed in the atomizing core outer sleeve 5. The tobacco tar inlet holes 7 are horizontally formed, and the axial line of the tobacco tar inlet hole is horizontal. The arrow direction in FIG. 1 is an tobacco tar guide direction. The tobacco tar guide cotton 1 is of a cup-shaped structure, the tobacco tar is guided to the side wall of the tobacco tar guide cotton 1 and is vertically guided to the surface of the atomizing piece 2 downward through a narrow slit between the atomizing core inner sleeve 4 and the atomizing core outer sleeve 5.

At least one groove 8 is formed in a position corresponding to the tobacco tar guide cotton 1, on the outer side wall of the atomizing core inner sleeve 4.

The atomizing core further includes an elastic bracket 9, a step 10 is formed on the inner side wall of the atomizing core inner sleeve 4, the top end of the elastic bracket 9 is clamped at the step 10, and the other end of the elastic bracket 9 extrudes the inner bottom surface of the tobacco tar guide cotton 1. The elastic bracket 9 is a spring.

Figure 4:
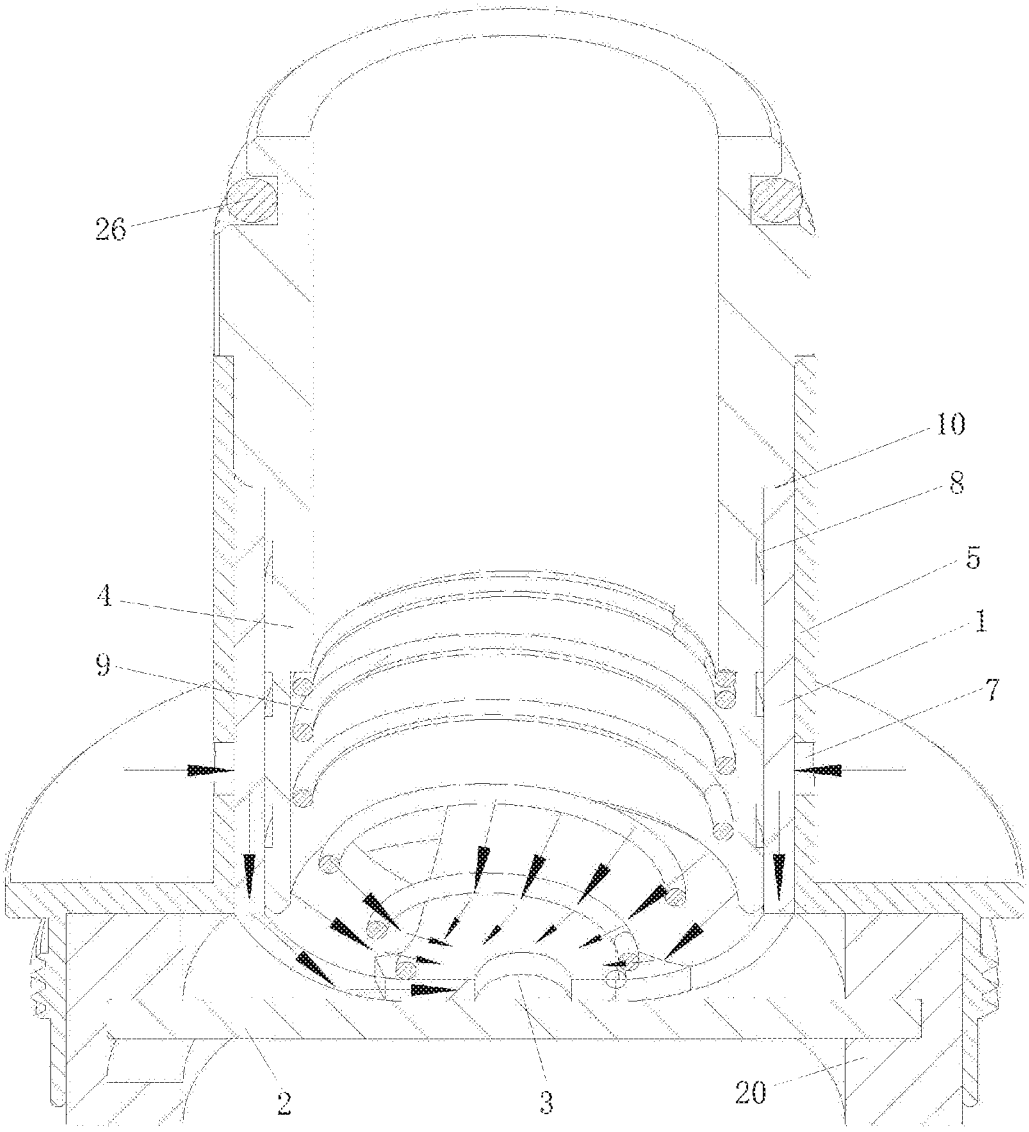
FIG. 4 is an oblique section view of an embodiment 2 of the atomizing core of the present invention.
Figure 5:
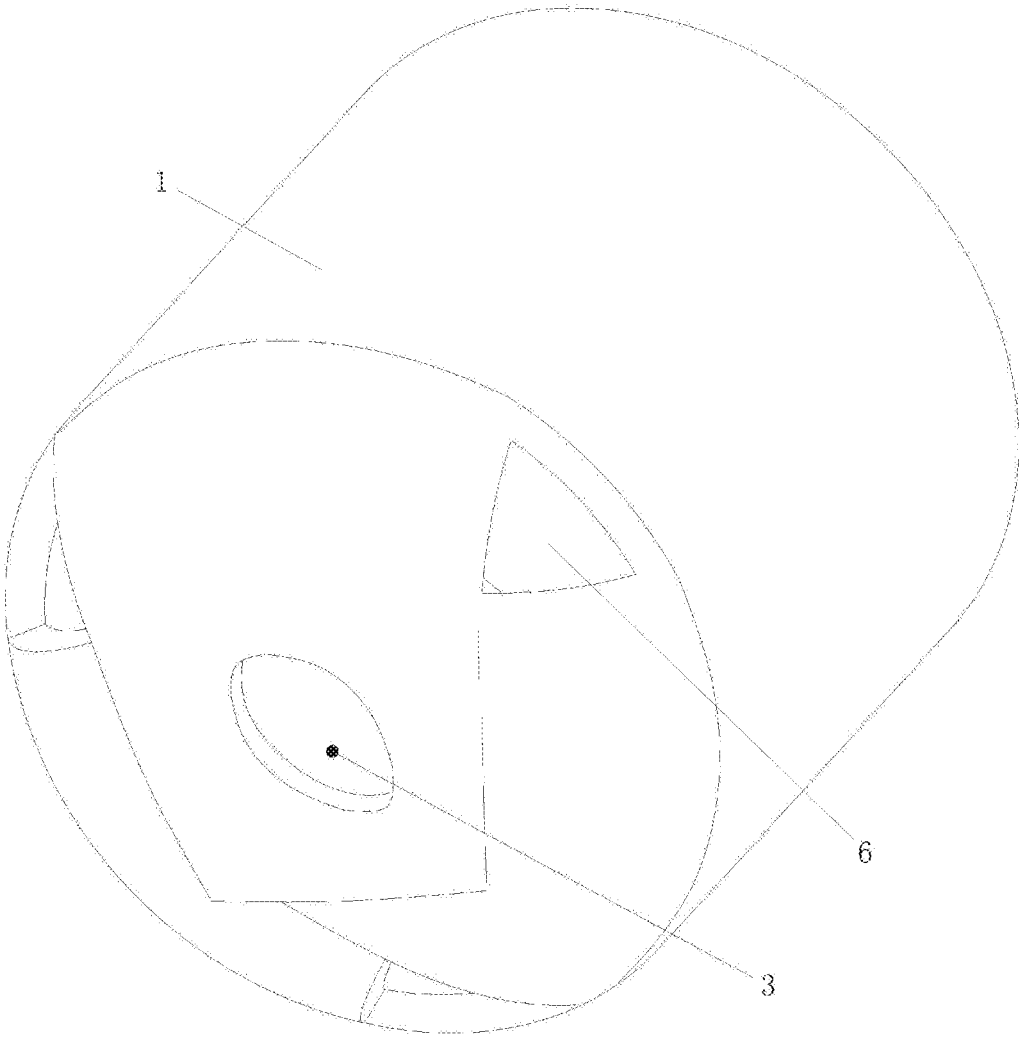
FIG. 5 is a structural schematic diagram of tobacco tar guide cotton in FIG. 4.

FIG. 4 and FIG. 5 show the structure of an embodiment 2 of the atomizing core of the present invention, the difference between the embodiment 2 and the embodiment 1 lies in that at least one second through hole 6 is further formed in the bottom surface of the tobacco tar guide cotton 1. The rest structure in embodiment 2 is the same as that in the embodiment 1, and thus will not be repeated redundantly herein. The arrow direction in FIG. 4 is an tobacco tar guide direction.

As shown in FIG. 5, in the embodiment 2, the bottom surface of the cup-shaped tobacco tar guide cotton 1 is sheared into multiple segments, several cotton segments are overlapped together, and the second through hole 6 is formed between two adjacent cotton segments. The tobacco tar guide cotton 1 is pressed at the central position of the atomizing piece 2 by the elastic bracket 9, and the first through hole 3 with a diameter of 0.2-3 mm is formed in a position corresponding to the central position of the atomizing piece 2, on each cotton segment.

As shown in FIG. 6 to FIG. 11, an embodiment of an atomizer of the present invention includes an atomizer outer pipe 11, and the ultrasonic electronic cigarette atomizing core in the embodiment 1 is arranged in the atomizer outer pipe 11.

Figure 6:
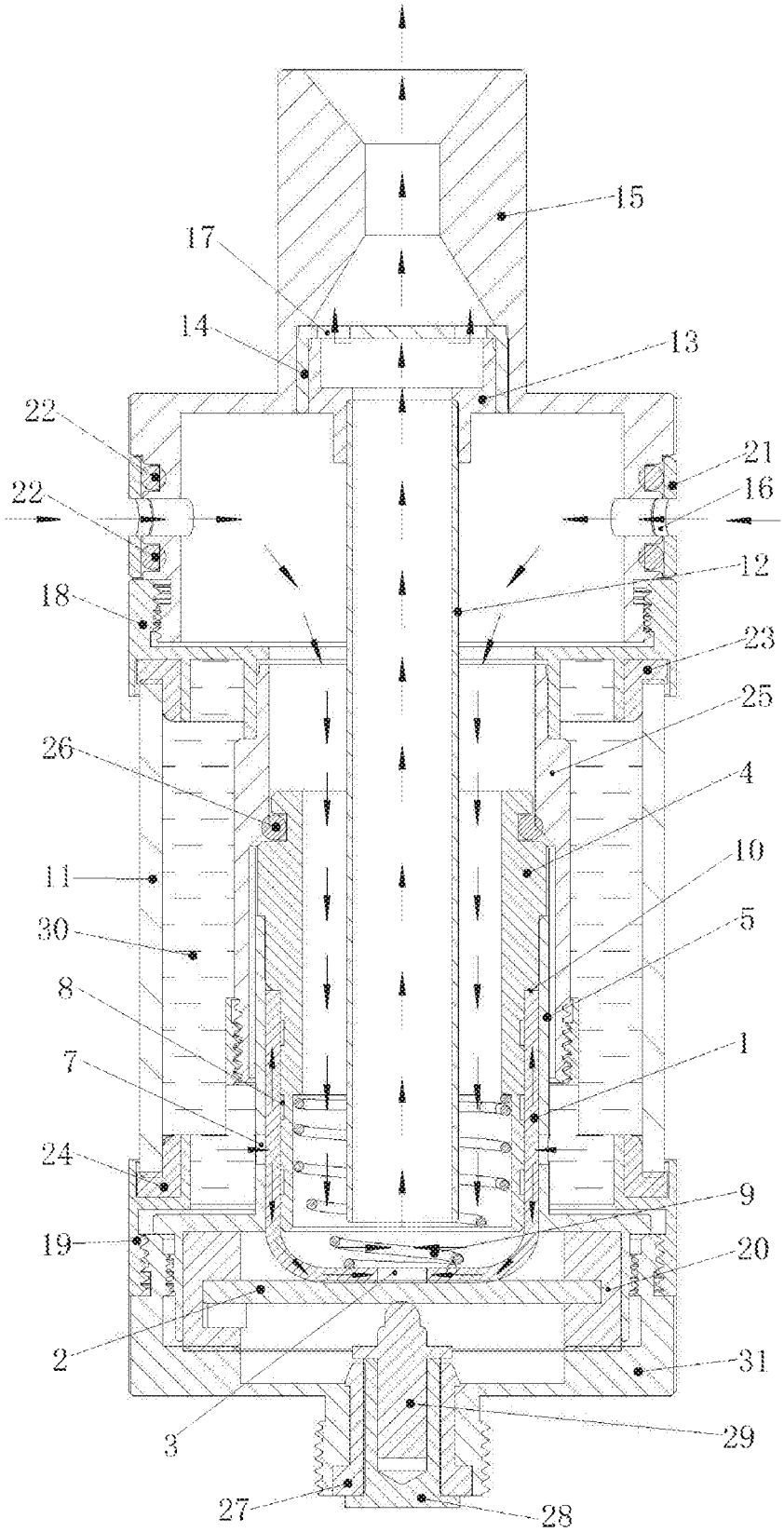
FIG. 6 is a front section view of an embodiment of an atomizer of the present invention.
Figure 7:
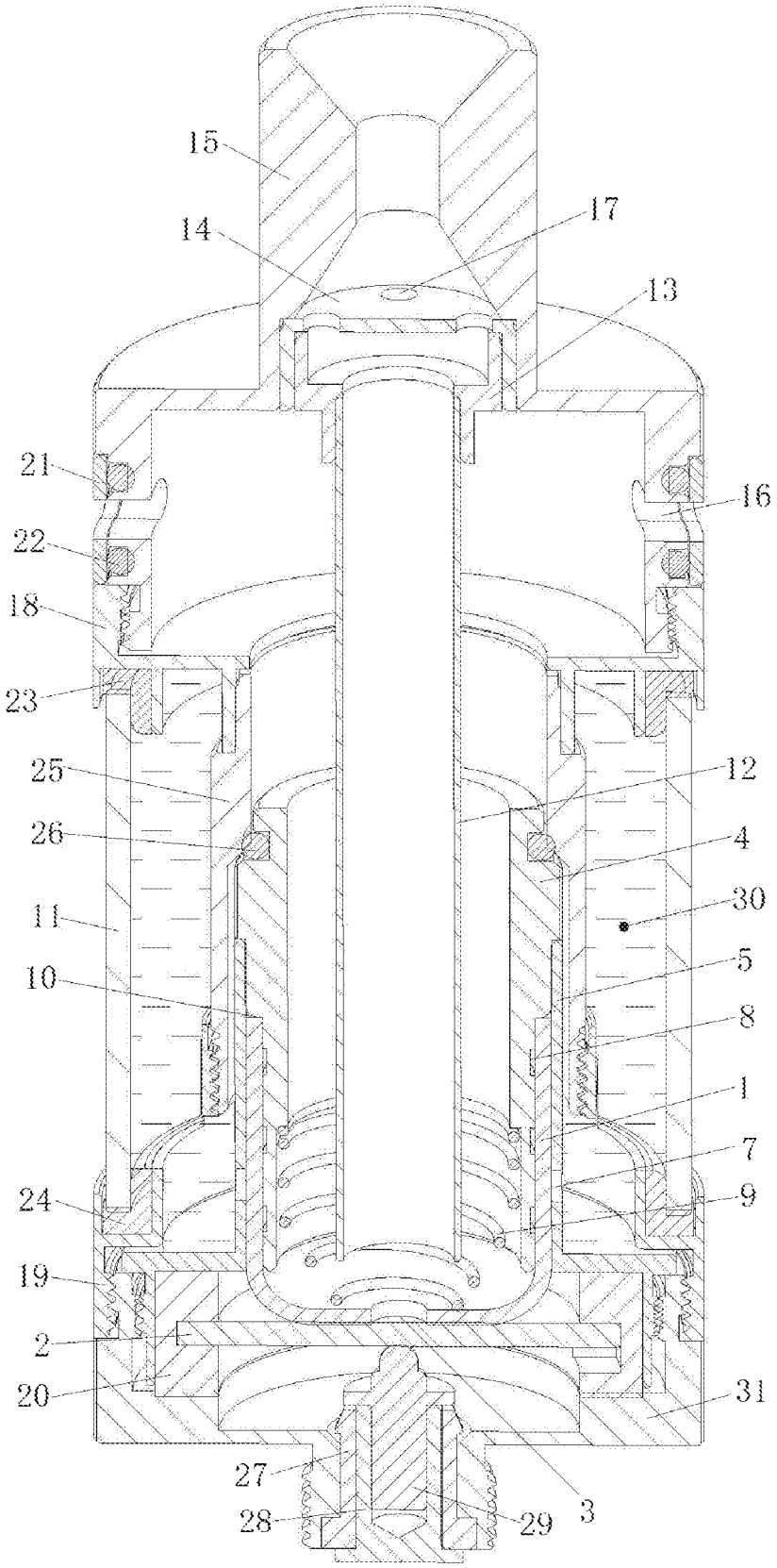
FIG. 7 is an oblique section view of FIG. 6.
Figure 8:
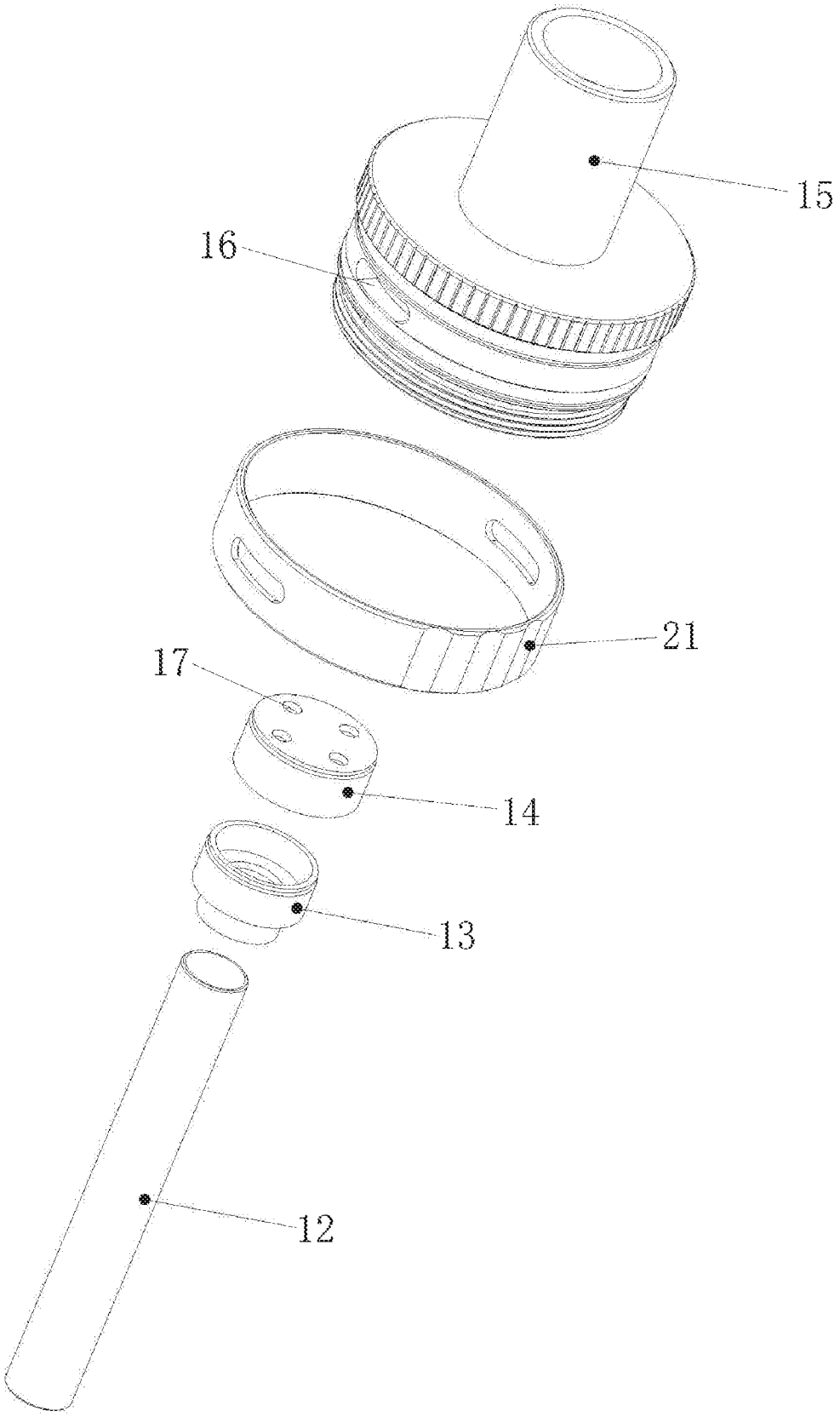
FIG. 8, FIG. 9, FIG. 10 and FIG. 11 constitute an explosive view of FIG. 6.
Figure 9:
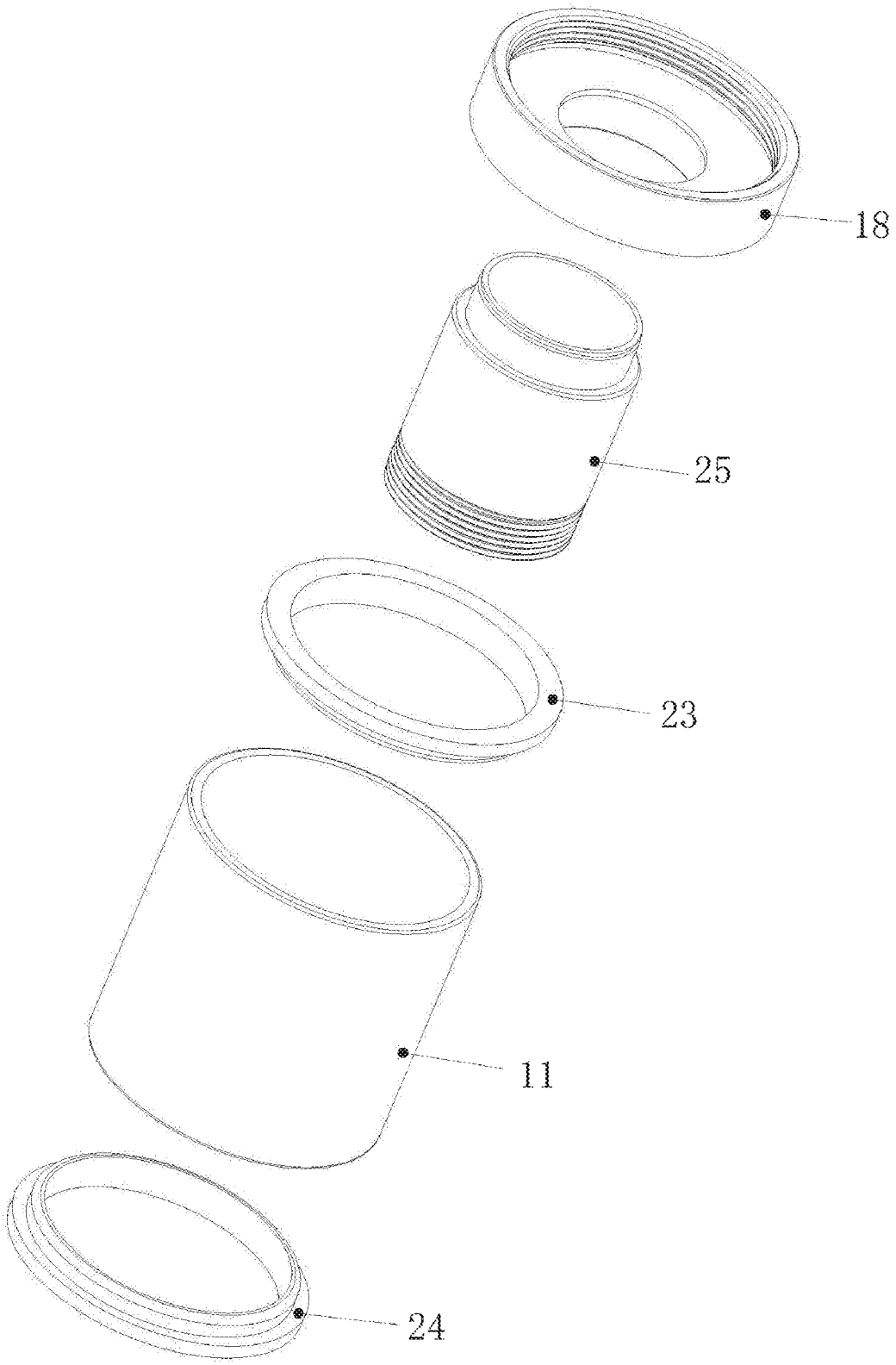
Figure 10:
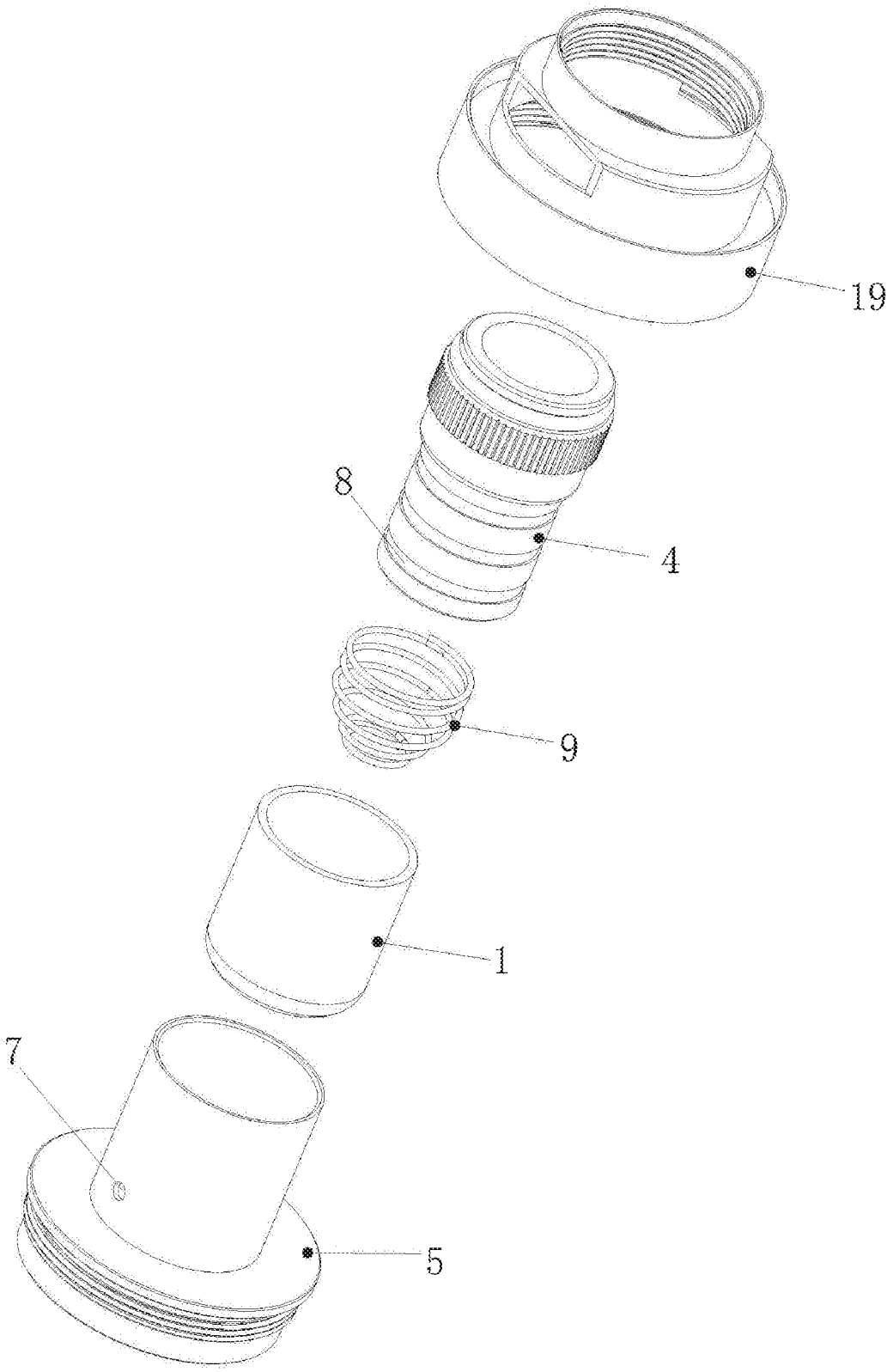
Figure 11:
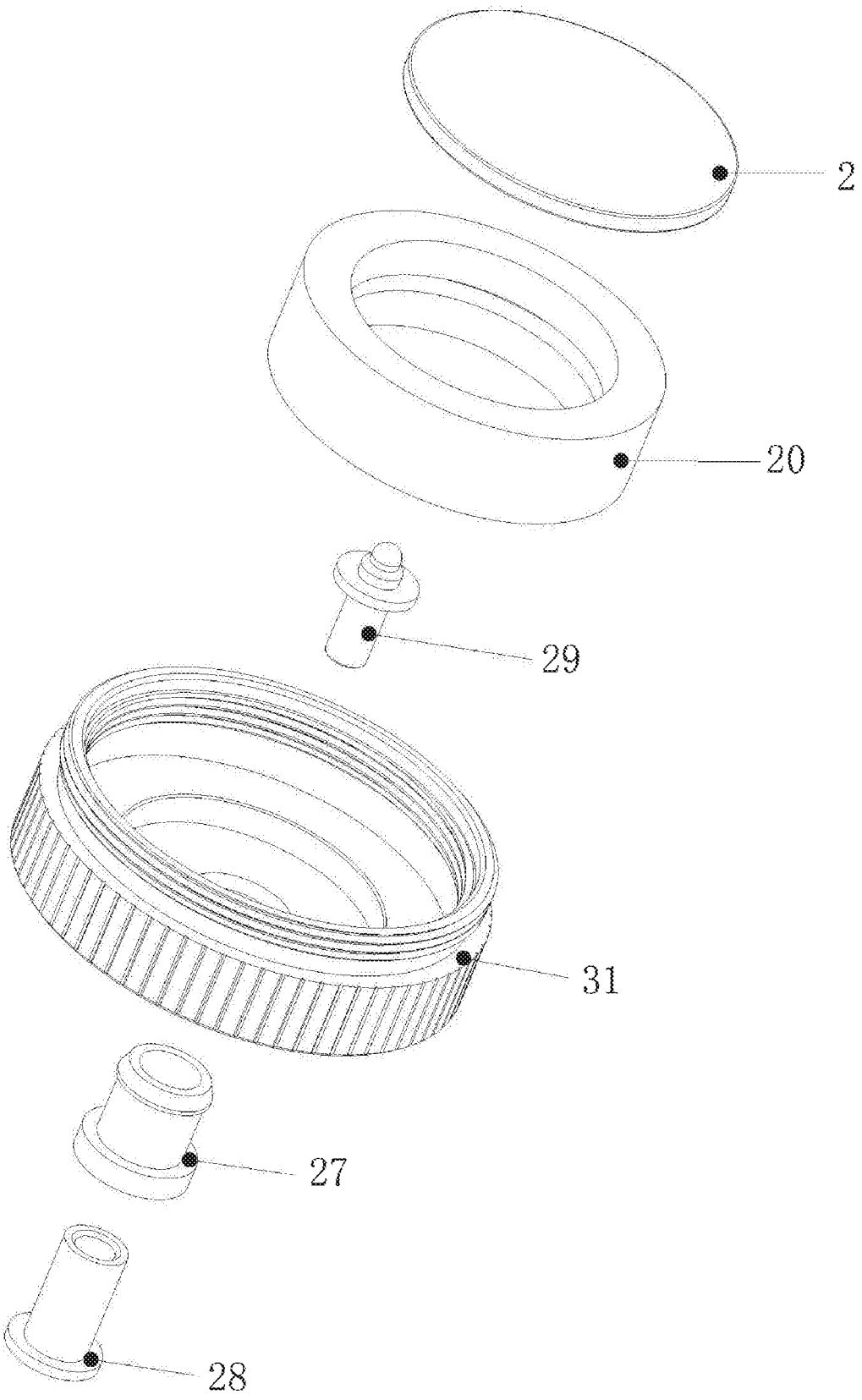

The atomizer further includes a vent pipe 12, a first connecting seat 13, an airflow baffle 14 and a suction nozzle 15, an air inlet hole 16 is formed in the side wall of the bottom of the suction nozzle 15, an air adjusting ring 21 is arranged at a position, corresponding to the air inlet hole 16, on the suction nozzle 15, and a first sealing ring 22 (the first sealing ring 22 is not shown in the explosive view of the atomizer, but it does not affect understanding and implementation of the present invention by those skilled in the art) is arranged between the air adjusting ring 21 and the suction nozzle 15. The bottom end of the suction nozzle 15 is connected with the top end of the side wall of the atomizer outer pipe 11, the bottom end of the vent pipe 12 extends into the atomizing core sleeve, the top end of the vent pipe 12 is connected with the airflow baffle 14 through the first connecting seat 13, and the airflow baffle 14 is horizontally arranged in the suction nozzle 15; at least one third through hole 17 is formed in the airflow baffle 14 in the circumferential direction; and all of the air inlet hole 16, the vent pipe 12 and the third through hole 17 communicate with the suction nozzle 15. The arrow direction in FIG. 6 is an airflow direction.

The bottom end of the suction nozzle 15 is connected with the top end of the side wall of the atomizer outer pipe 11 through an upper end cover 18, and the bottom end of the side wall of the atomizer outer pipe 11 is connected with a bottom seat 31 through a lower end cover 19; an upper sealing ring 23 is arranged between the upper end cover 18 and the top end of the side wall of the atomizer outer pipe 11, and a lower sealing ring 24 is arranged between the lower end cover 19 and the bottom end of the side wall of the atomizer outer pipe 11. A second connecting seat 25 is arranged in the upper end cover 18, the top end of the atomizing core is in insertion connection with the upper end cover 18 through the second connecting seat 25, and the bottom end of the atomizing core is in screw joint with the bottom seat 31. A second sealing ring 26 (the second sealing ring 26 is not shown in the explosive view of the atomizer, but it does not affect understanding and implementation of the present invention by those skilled in the art) is arranged between the top end of the atomizing core and the inner side wall of the second connecting seat 25. An tobacco tar bin 30 is arranged between the inner side wall of the atomizer outer pipe 11 and the outer side wall of the second connecting seat 25.

A through hole which accommodates an insulating ring 27 is formed in the bottom surface of the bottom seat 31, and an electrode ring 28 is sheathed in the insulating ring 27. The atomizer further includes a spring electrode 29, the bottom end of the spring electrode 29 extends into the electrode ring 28, and the top end of the spring electrode 29 is in contact with the bottom surface of the atomizing piece 2.

Figure 12:
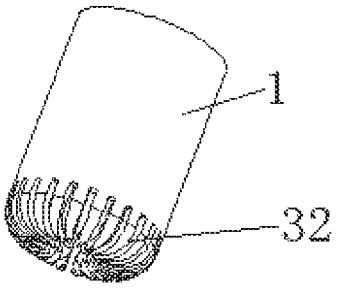
FIG. 12 is a structural schematic diagram of another embodiment of the tobacco tar guide cotton.

As shown in FIG. 12, it is another structural schematic diagram of the tobacco tar guide cotton 1 in the present invention, vent grooves 32 are uniformly formed in a boundary area of the side wall and the bottom of the tobacco tar guide cotton 1 in the circumferential direction, and the area provided with no vent groove 32 at the bottom of the tobacco tar guide cotton 1 is contacted with the atomizing piece 2.

Although the embodiments of the present invention have been described above in combination with the drawings, the present invention is not limited to the specific implementations described above, and the specific implementations described above are merely illustrative and are not restrictive, those of ordinary skill in the art can also make a lot of forms under the enlightenment of the present invention without departing from the purpose of the present invention or the protection scope of the claims, and all these forms fall within the protection scope of the present invention.

The invention claimed is:

1. An ultrasonic electronic cigarette atomizing core, comprising an atomizing core sleeve, tobacco tar guide cotton, and an atomizing piece in the atomizing core sleeve, wherein:

a bottom surface of the tobacco tar guide cotton is in contact with a top surface of the atomizing piece, a first through hole is formed in a position on the tobacco tar guide cotton, which corresponds to the center of the atomizing piece, the atomizing core sleeve comprises an atomizing core inner sleeve and an atomizing core outer sleeve sheathed at an outside of the atomizing core inner sleeve, the tobacco tar guide cotton is of a cup-shaped structure with an upward opening, and a side wall of the tobacco tar guide cotton is sandwiched between the atomizing core inner sleeve and the atomizing core outer sleeve.

2. The ultrasonic electronic cigarette atomizing core of claim 1, wherein at least one second through hole is further formed in the bottom surface of the tobacco tar guide cotton.

3. The ultrasonic electronic cigarette atomizing core of claim 1, wherein vent grooves are uniformly formed in a boundary area of the side wall and the bottom surface of the tobacco tar guide cotton in the circumferential direction, and the area provided with no vent groove at the bottom surface of the tobacco tar guide cotton is in contact with the atomizing piece.

4. The ultrasonic electronic cigarette atomizing core of claim 1, wherein the bottom surface of the tobacco tar guide cotton is a downward protruding circular arc surface, and the circular arc surface is in contact with a central area of the atomizing piece.

5. The ultrasonic electronic cigarette atomizing core of claim 1, wherein a tobacco tar inlet hole leading to the tobacco tar guide cotton is formed in the atomizing core outer sleeve.

6. The ultrasonic electronic cigarette atomizing core of claim 1, wherein at least one groove is formed in a position, which corresponds to the tobacco tar guide cotton, on an outer side wall of the atomizing core inner sleeve.

7. The ultrasonic electronic cigarette atomizing core of claim 1, wherein:

the ultrasonic electronic cigarette atomizing core further comprises an elastic bracket, a step is formed on an inner side wall of the atomizing core inner sleeve, a top end of the elastic bracket is clamped at the step, and an other end of the elastic bracket extrudes an inner bottom surface of the tobacco tar guide cotton.

8. An ultrasonic electronic cigarette atomizer, comprising an atomizer outer pipe, wherein an ultrasonic electronic cigarette atomizing core is arranged in the atomizer outer pipe, the ultrasonic electronic cigarette atomizing core comprising an atomizing core sleeve, tobacco tar guide cotton, and an atomizing piece in the atomizing core sleeve, wherein:

a bottom surface of the tobacco tar guide cotton is in contact with a top surface of the atomizing piece, a first through hole is formed in a position on the tobacco tar guide cotton, which corresponds to the center of the atomizing piece, the atomizing core sleeve comprises an atomizing core inner sleeve and an atomizing core outer sleeve sheathed at an outside of the atomizing core inner sleeve, the tobacco tar guide cotton is of a cup-shaped structure with an upward opening, and a side wall of the tobacco tar guide cotton is sandwiched between the atomizing core inner sleeve and the atomizing core outer sleeve.

9. The ultrasonic electronic cigarette atomizer of claim 8, wherein the ultrasonic electronic cigarette atomizer further comprises a vent pipe, a first connecting seat, an airflow baffle, and a suction nozzle, wherein:

an air inlet hole is formed in a side wall of a bottom of the suction nozzle, a bottom end of the suction nozzle is connected with a top end of a side wall of the atomizer outer pipe, a bottom end of the vent pipe extends into the atomizing core sleeve, a top end of the vent pipe is connected with the airflow baffle through the first connecting seat, and the airflow baffle is horizontally arranged in the suction nozzle;

at least one third through hole is formed in the airflow baffle in a circumferential direction; and the air inlet hole, the vent pipe, and the third through hole all communicate with the suction nozzle.

10. The ultrasonic electronic cigarette atomizer of claim 9, wherein:

the bottom end of the suction nozzle is connected with a top end of the side wall of the atomizer outer pipe through an upper end cover, and a bottom end of the side wall of the atomizer outer pipe is connected with a bottom seat through a lower end cover; and a top end of the atomizing core is in insertion connection with the upper end cover, and a bottom end of the atomizing core is in screw joint with the bottom seat.

11. The ultrasonic electronic cigarette atomizer of claim 8, wherein at least one second through hole is further formed in the bottom surface of the tobacco tar guide cotton.

12. The ultrasonic electronic cigarette atomizer of claim 8, wherein vent grooves are uniformly formed in a boundary area of the side wall and the bottom surface of the tobacco tar guide cotton in the circumferential direction, and the area provided with no vent groove at the bottom surface of the tobacco tar guide cotton is in contact with the atomizing piece.

13. The ultrasonic electronic cigarette atomizer of claim 8, wherein the bottom surface of the tobacco tar guide cotton is a downward protruding circular arc surface, and the circular arc surface is in contact with a central area of the atomizing piece.

14. The ultrasonic electronic cigarette atomizer of claim 8, wherein a tobacco tar inlet hole leading to the tobacco tar guide cotton is formed in the atomizing core outer sleeve.

15. The ultrasonic electronic cigarette atomizer of claim 8, wherein at least one groove is formed in a position, which corresponds to the tobacco tar guide cotton, on an outer side wall of the atomizing core inner sleeve.

16. The ultrasonic electronic cigarette atomizer of claim 8, wherein:

the ultrasonic electronic cigarette atomizing core further comprises an elastic bracket, a step is formed on an inner side wall of the atomizing core inner sleeve, a top end of the elastic bracket is clamped at the step, and an other end of the elastic bracket extrudes an inner bottom surface of the tobacco tar guide cotton.

* * * * *